US005694842A

United States Patent [19]

Casl

[11] Patent Number: 5,694,842

[45] Date of Patent: Dec. 9, 1997

[54] ANGLED SQUEEGEE SYSTEM FOR SCREEN PRINTING ONTO A SUBSTRATE

[75] Inventor: Slobodan Casl, Williamstown, N.J.

[73] Assignees: Sony Corporation, Tokyo, Japan; Sony Music Entertainment Inc., New York, N.Y.

[21] Appl. No.: 591,993

[22] Filed: Jan. 26, 1996

[51] Int. Cl.[6] ..... B41F 15/44

[52] U.S. Cl. ..... 101/123; 101/114

[58] Field of Search ..... 101/114, 120, 101/123, 124, 169, 350, 364–366

[56] References Cited

U.S. PATENT DOCUMENTS

| | | | |
|---|---|---|---|
| 3,307,235 | 3/1967 | Hennings | 24/535 |
| 3,986,746 | 10/1976 | Chartier | 294/116 |
| 4,051,777 | 10/1977 | Black et al. | 101/123 |
| 4,080,893 | 3/1978 | Wedell | 101/124 |
| 4,122,771 | 10/1978 | Barton et al. | 101/123 |
| 4,173,185 | 11/1979 | Voegelin | 101/124 |
| 4,329,936 | 5/1982 | Heist et al. | 101/124 |
| 4,638,733 | 1/1987 | Schneider et al. | 101/114 |
| 4,700,437 | 10/1987 | Hoshino | 24/456 |
| 4,805,938 | 2/1989 | Redmond et al. | 280/209 |
| 4,989,512 | 2/1991 | Lindström et al. | 101/123 |
| 5,078,063 | 1/1992 | Johansen et al. | 101/480 |
| 5,101,722 | 4/1992 | Nagatani | 101/124 |
| 5,343,802 | 9/1994 | Shimada | 101/123 |
| 5,458,060 | 10/1995 | Casl | 101/123 |
| 5,522,929 | 6/1996 | Erdmann | 101/123 |
| 5,524,540 | 6/1996 | Van Denend | 101/169 |

FOREIGN PATENT DOCUMENTS

| | | | |
|---|---|---|---|
| 167267 | 10/1982 | Japan | 101/123 |

OTHER PUBLICATIONS

"Polyurethane Squeegees" Screen Printing, Jun. 1978, p. 66, class 101 sub 123.

*Primary Examiner*—Stephen R. Funk
*Attorney, Agent, or Firm*—Peter C. Toto; Jerry A. Miller

[57] ABSTRACT

An improved squeegee for a screen printing system. A squeegee with two substantially rectangular shaped elements adjacent each other and each having a longitudinal axis. The longitudinal axes are not aligned and instead intersect at an angle unequal to zero. Alternatively, the improved squeegee for a screen printing system may include a center section with outward projections, a first substantially rectangular shaped element adjacent the center section and having a first longitudinal axis and a second substantially rectangular shaped element adjacent to the center section and having a second longitudinal axis, the first longitudinal axis and the second longitudinal axis intersecting at an angle unequal to zero.

12 Claims, 6 Drawing Sheets

ANGLED SQUEEGEE SYSTEM FOR SCREEN PRINTING ONTO A SUBSTRATE

1. FIELD OF THE INVENTION

This invention relates generally to the field of screen printing squeegees. More particularly, the present invention relates to an angled squeegee system that eliminates the need to tilt an entire squeegee holder assembly in order to screen print onto a substrate.

2. BACKGROUND OF THE INVENTION

In halftone and four color process screen printing onto a substrate, such as a compact disc, there are many variables which affect the printing quality. One such variable is the angle at which the squeegee is applied to the screen. This angle is effected in two ways: by tilting the entire squeegee assembly and by varying the durometer measurement of the material used to construct the squeegee. Although varying durometers allow the squeegee edge to bend to a different extent when downward pressure is applied, the entire squeegee assembly must still be tilted in order to create an appropriate angle of incidence between a squeegee edge and the substrate. Depending on the desired output characteristics, i.e. color, hue, and dot size, the angle at which the squeegee is tilted varies.

Most common squeegee holders, similar to the squeegee holder in FIG. 1, require that the entire squeegee holder assembly 15 be tilted by a machine operator to the desired angle 40 (which is generally between about 10° and 20°) in order for the squeegee 20 to be at a desired angle. This method of angling the squeegee is time intensive as it must be done by trial and error. While an experienced operator takes a shorter amount of time to set up the angle, repeatability is not measurable and is hard to achieve. Since different angles are required to achieve different colors or printing effects, repeated adjustments are necessary during a four color or halftone printing process and the time it takes to change the angle lengthens the printing process. This, of course, is undesirable because a prohibitive printing time increases printing costs and limits the broad range of possible designs that can be used.

Another method of setting up the squeegee angle is to have a squeegee head assembly similar to the one in FIG. 2. In this instance, the squeegee holder 75 has a clamping slot 78 that is inclined so that a squeegee 80 with a substantially rectangular cross section may be angled by the squeegee head assembly and not the machine operator. This type of squeegee head assembly is inconvenient for halftone printing or four color process printing because such printing processes require multiple angles to achieve specific characteristics, i.e. color, hue, and dot size, and therefore would require separate squeegee head assemblies for each angle to complete the entire printing process making the entire process more expensive and lengthy. The present invention seeks to improve print quality and print time by using an improved squeegee which provides accurate and rapid set up of angles.

3. SUMMARY OF THE INVENTION

It is an object of the present invention to provide an improved squeegee.

It is a feature of the present invention that it can be adapted to work with a squeegee holder which uses traditional squeegees or a squeegee holder having opposed cutouts.

It is a feature that the present invention provides rapid and precise set up of a squeegee at a specific angle.

It is an advantage that an operator does not have to manually adjust the angle at which the squeegee must be set for the desired output.

It is a further advantage that an operator does not have to use trial and error to obtain the proper angle for optimum output.

It is a further advantage that only one head assembly is required for a variety of different angles.

These and other objects, advantages and features of the invention will become apparent to those skilled in the art upon consideration of the following description of the invention.

In one embodiment of the present invention, the improved squeegee for a screen printing system includes two substantially rectangular elements adjacent each other and each having a longitudinal axis. The longitudinal axes are not aligned but instead intersect at an angle unequal to zero.

Another embodiment of the present invention is an improved screen printing squeegee system which utilizes a squeegee holder having opposed cutouts. A squeegee including a center section having outward projections for positioning the squeegee within the cutouts, a first substantially rectangular shaped element adjacent to the center section and having a first longitudinal axis and a second substantially rectangular shaped element adjacent to the center and having a second longitudinal axis, the first longitudinal axis and the second longitudinal axis intersecting at an angle unequal to zero, are also provided.

The features of the invention believed to be novel are set forth with particularity in the appended claims. The invention itself however, both as to organization and method of operation, together with further objects and advantages thereof, may be best understood by reference to the following description taken in conjunction with the accompanying drawing.

4. BRIEF DESCRIPTION OF THE DRAWINGS

5. DETAILED DESCRIPTION OF THE INVENTION

Figure 1:
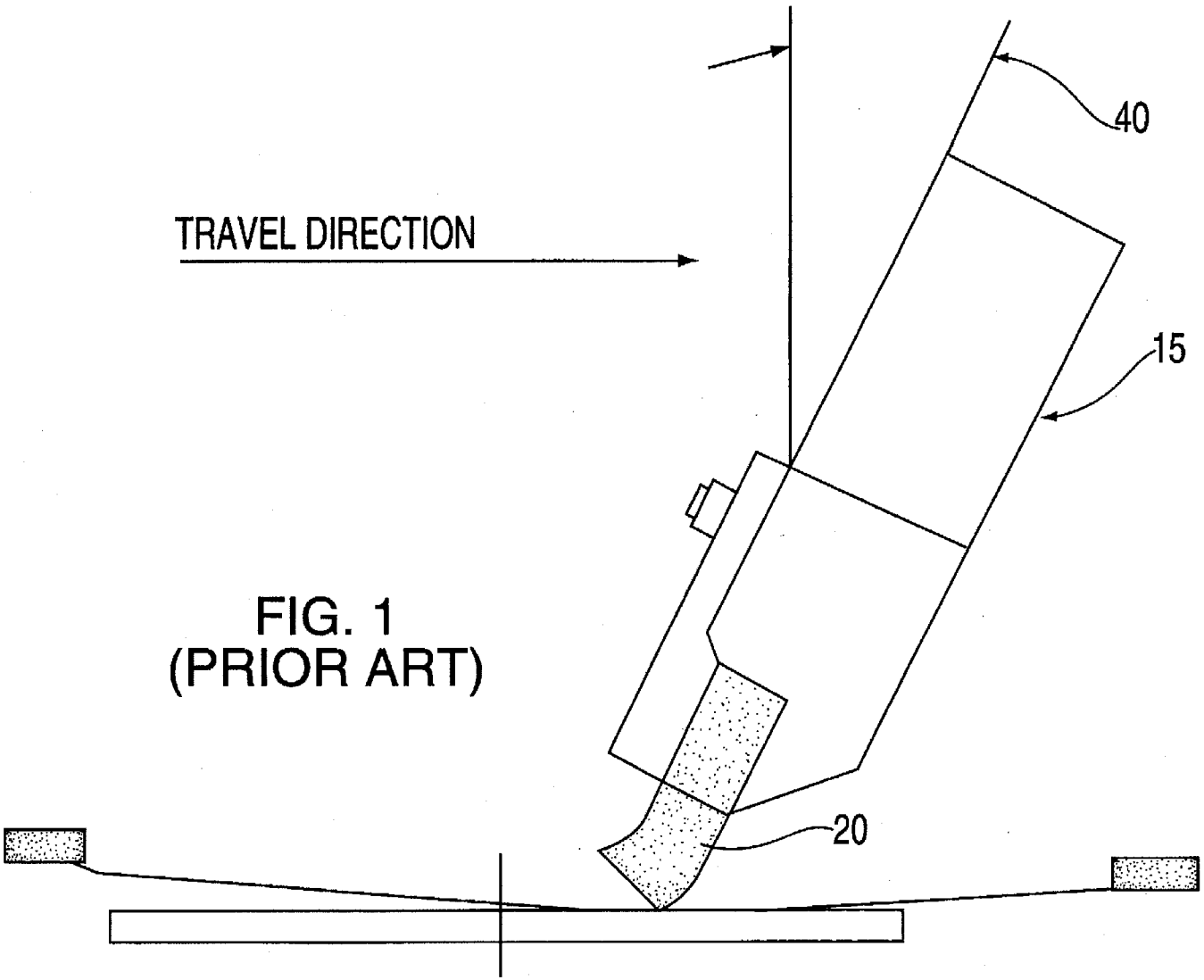
FIG. 1 (PRIOR ART)
FIG. 1 is an illustration of a prior art squeegee holder in operation.
Figure 2:
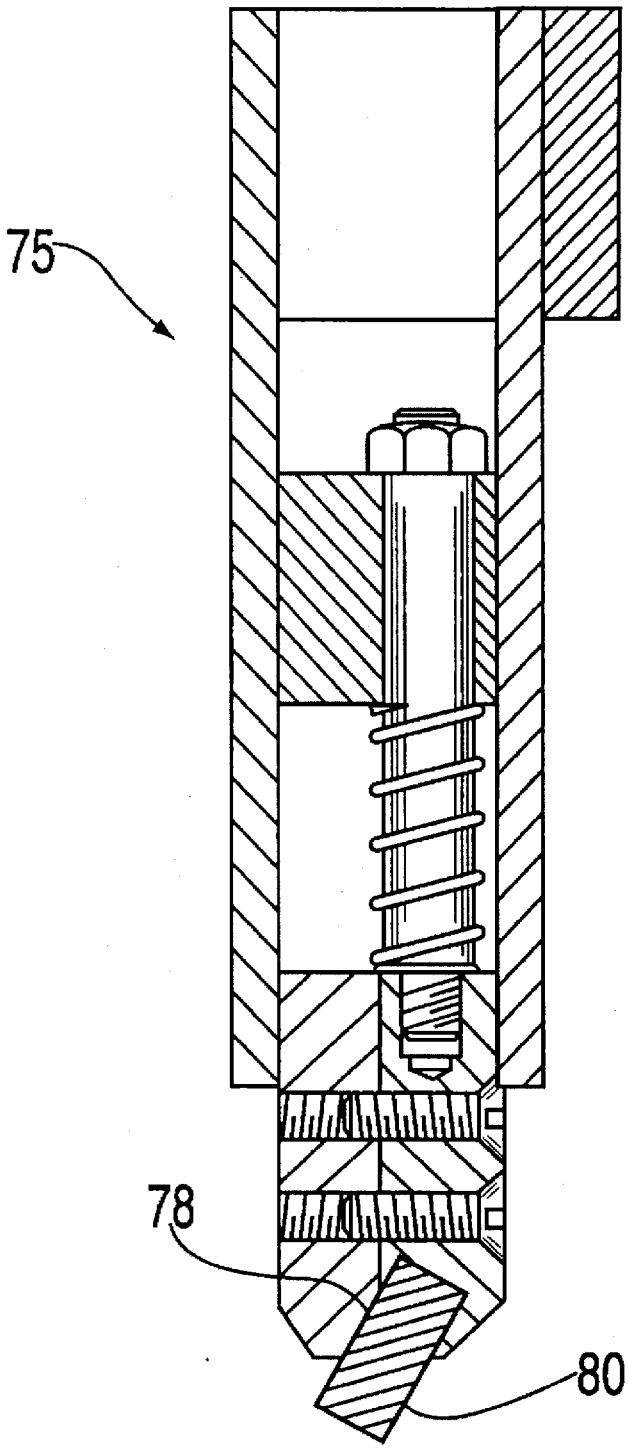
FIG. 2 (PRIOR ART)
FIG. 2 is a cross sectional view of a prior art squeegee holder which includes an inclined clamping slot.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described.

Figure 3:
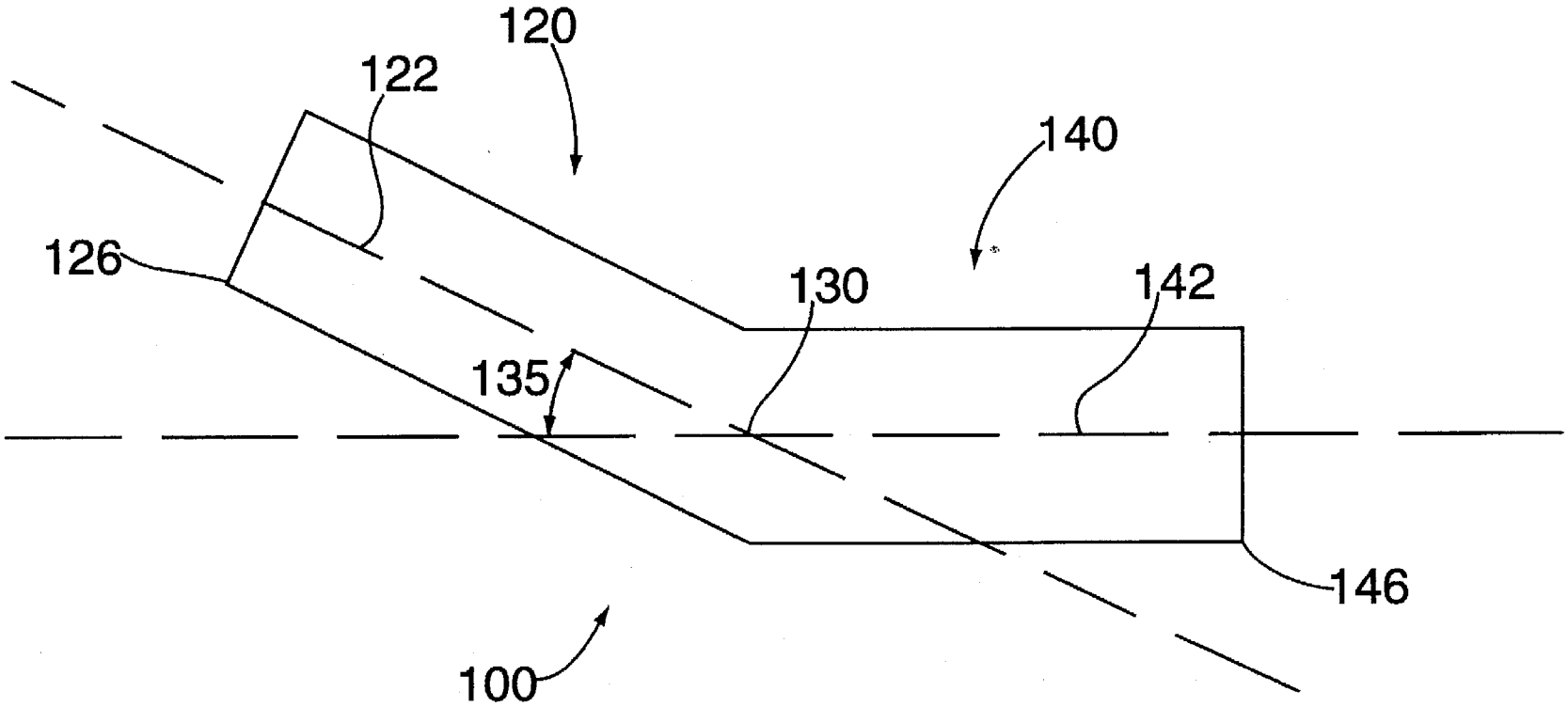
FIG. 3 is a side view of a squeegee embodying the present invention.

Referring now to FIG. 3, the improved squeegee 100 of the present invention is shown in a side view. Squeegee 100 has two rectangular shaped elements 120, 140 adjacent each other and each having a longitudinal axis 122, 142, respectively. The longitudinal axes 122, 142 can be thought of as extending infinitely. Importantly, the longitudinal axis 122 and the longitudinal axis 142 are not aligned but intersect at point 130 and form angle 135 which is greater than or less than 0° (i.e., unequal to 0°). Standard printing requires that the angle be approximately 10°–12°. For halftone printing, an angle approximately between 16°–20° is commonly required. In this embodiment, each rectangular shaped element 120, 140 has one edge 126, 146, respectively, that is used for printing in the fashion accustomed to by those skilled in the art. When one rectangular shaped element, i.e. 120, is clamped by a squeegee holder (see FIG. 5), the other rectangular shaped element's edge, i.e. 146, is used to make contact with a screen for printing. As such, when one of the rectangular elements of the squeegee wears out, e.g., the corner 146 which is in contact with the printing surface, the squeegee can be flipped over and corner 126 can be used while the squeegee retains the proper angle between the rectangular elements. While FIG. 3 shows the two rectangular shaped elements 120, 140 of substantially equal length, they can be of different lengths depending on the desired application. The squeegee 100 can be made by single cavity cast molding, injection molding or extrusion molding. The squeegee can be molded of polyurethane with a durometer measurement between 60 and 95. Additionally, the squeegee can be molded of polyester or polyether which is preferable because of its better abrasion resistance and therefore lasts longer. Polyether is used for durometer measurements between 70 and 75 and polyester is used for a durometer measurement between 80 and 95.

Figure 4:
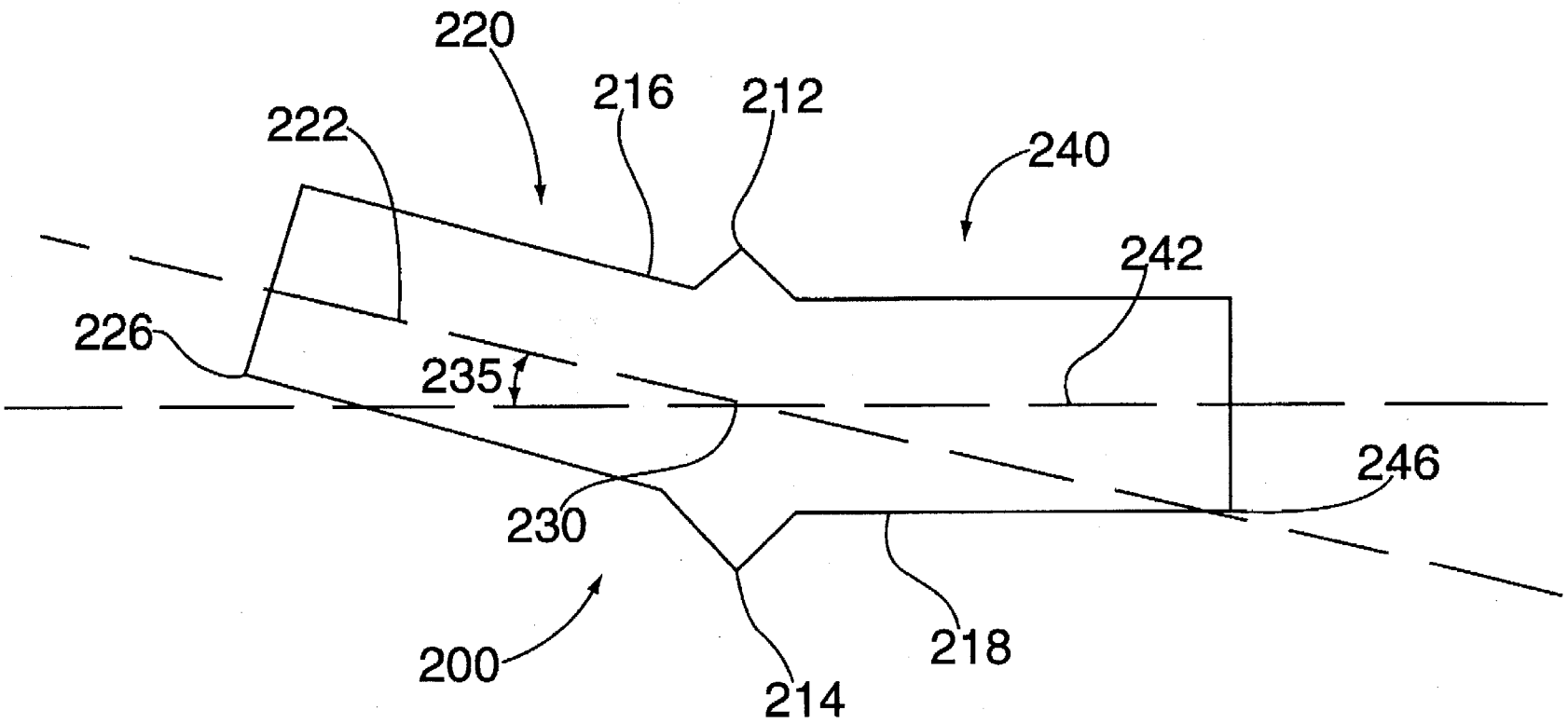
FIG. 4 is a side view of a squeegee embodying the present invention which includes a center section having outward projections.
Figure 6:
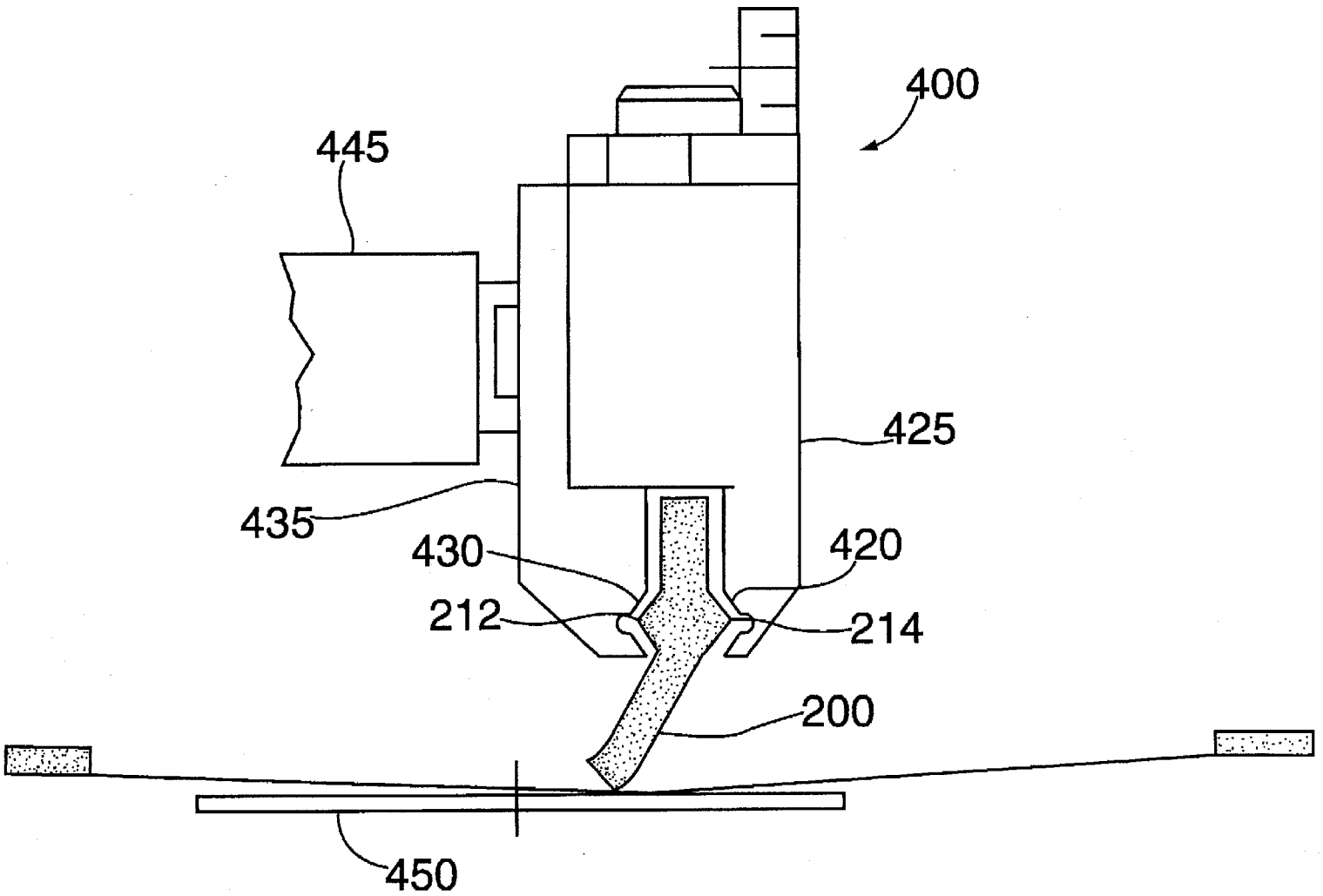
FIG. 6 is a side view of a squeegee holder for use with the squeegee of FIG. 4.

FIG. 4 shows another embodiment of the invention, squeegee 200, shown also in a side view. Squeegee 200 has two rectangular shaped elements 220, 240 each having a longitudinal axis 222, 242, respectively. Additionally, squeegee 200 has opposing projections 212, 214 located along the surfaces 216, 218, respectively, and in between the two rectangular shaped elements 220, 240. The illustrated projections 212, 214 are shown as comers but they can be various shapes and sizes. The longitudinal axes 222, 242 can be thought of as extending infinitely. FIG. 6 shows the projections 212, 214 fitting into V-shaped channels 420, 430 of clamping plates 425, 435, used in a print assembly 400. Looking again to FIG. 4, the longitudinal axis 222 and the longitudinal axis 242 are not aligned but intersect at a point 230 and form angle 235 which is greater than or less than 0° (i.e. unequal to 0°). In this embodiment there are two edges 226, 246 of the rectangular shaped elements 220, 240 that can be used for printing in the fashion accustomed to those skilled in the art. As such, when one of the rectangular elements of the squeegee wears out, e.g., the corner 226 which is in contact with the printing surface, the squeegee can be flipped over and corner 246 can be used while the squeegee retains the proper angle between the rectangular elements. While FIG. 4 shows the two rectangular shaped elements 220, 240 of substantially equal length, they can be of different lengths depending on the desired application. The two rectangular shaped elements 220, 240 and the opposed projections 212, 214 can be constructed in the same manner described above with regard to the first embodiment.

Figure 5:
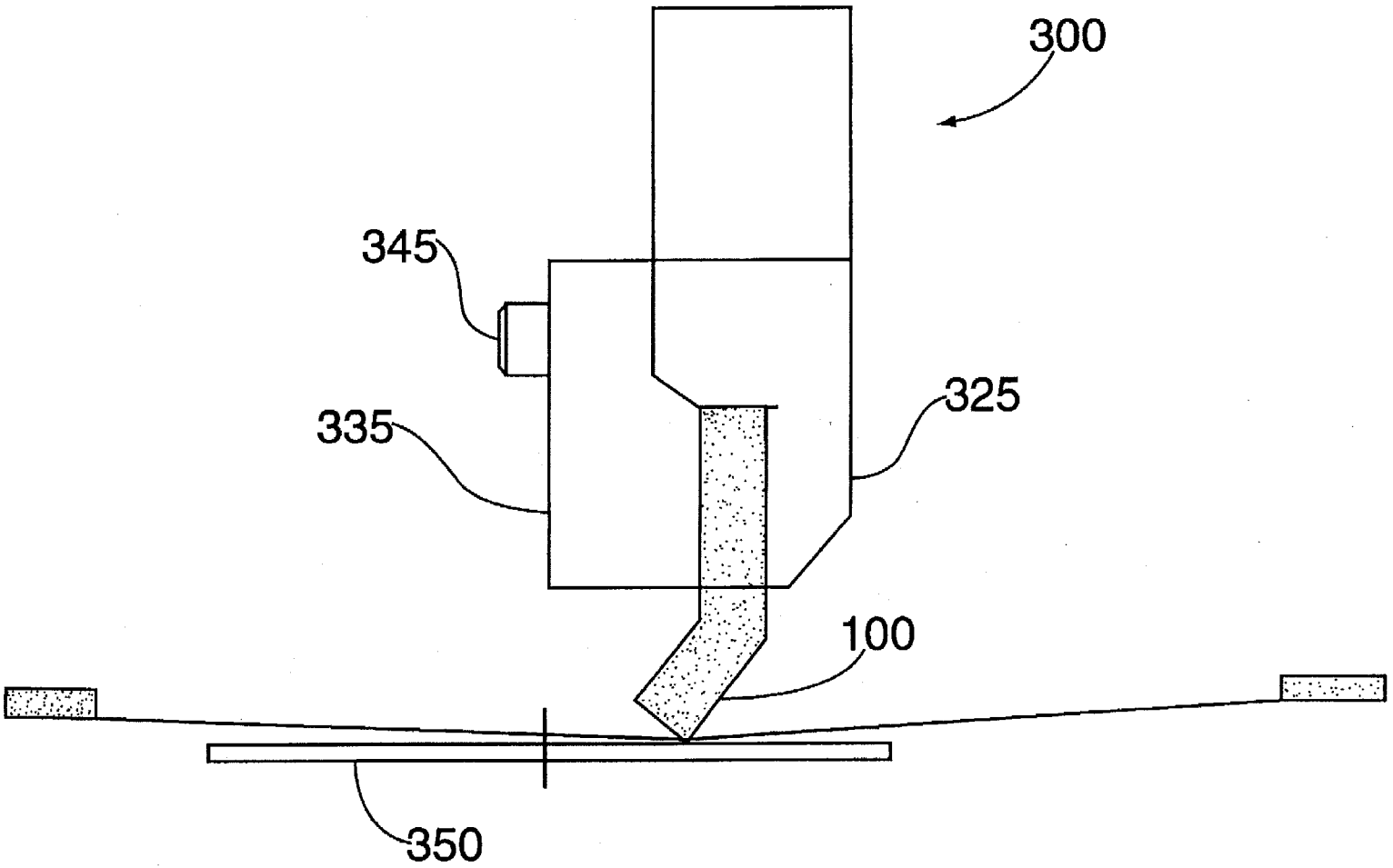
FIG. 5 is a side view of a squeegee holder for use with the squeegee of FIG. 3.

FIG. 5 shows an improved screen printing squeegee assembly 300 which utilizes the squeegee 100 of the present invention. The squeegee 100 is clamped within two clamping plates 325, 335 by a clamping means 345 which might be a screw, bolt or clamping tool. As can be observed by this figure, the screen printing squeegee assembly 300 does not need to be titled because the desired angle of the squeegee is obtained through the shape of the squeegee 100. Therefore, the screen printing squeegee assembly 300 remains perpendicular to the substrate 350. In addition, changing the desired printing angle is quick, easy and accurate because the squeegee 100 is simply replaced by a different squeegee having a different angle between its rectangular elements.

FIG. 6, which is similar to FIG. 5, shows an improved screen printing squeegee assembly 400 which utilizes the squeegee 200 of the present invention. The squeegee 200 is clamped within two clamping plates 425, 435 by a clamping means 445 which might be a screw, bolt or clamping tool. Accordingly, the screen printing squeegee assembly 400 does not need to be tilted because the desired angle of the squeegee is obtained by the shape of the squeegee 200. Therefore, the screen printing assembly 400 remains perpendicular to the substrate 450. In addition, changing the desired printing angle is quick, easy and accurate because the squeegee 200 is simply replaced by a different squeegee having a different angle between its rectangular elements.

Thus it is apparent that in accordance with the present invention, an apparatus that fully satisfies the objectives, aims and advantages is set forth above. While the invention has been described in conjunction with specific embodiments, it is evident that many alternatives, modifications, permutations and variations will become apparent to those skilled in the art in light of the forgoing description. Accordingly, it is intended that the present invention embrace all such alternatives, modifications and variations as fall within the scope of the appended claims.

What is claimed is:

1. A squeegee for use in a holder having opposed cutouts comprising:

a center section having outward projections for positioning within said cutouts to secure said squeegee in said holder;

a first substantially rectangular shaped element having a first planar working surface adjacent to said center section and having a first longitudinal axis, at least one of said outward projections extending above said first planar working surface; and a second substantially rectangular shaped element having a second planar working surface adjacent to said center section and having a second longitudinal axis, at least one of said outward projections extending above said second planar working surface, said first longitudinal axis and said second longitudinal axis intersecting at an angle unequal to zero.

2. A squeegee according to claim 1, wherein the rectangular shaped elements are of different lengths.

3. A squeegee according to claim 1, wherein said first and second substantially rectangular shaped elements are unistructurally formed.

4. A squeegee according to claim 1, wherein said angle is between 10° and 12°.

5. A squeegee according to claim 1, wherein said angle is between 16° and 20°.

6. A squeegee according to claim 1, wherein said squeegee is made of polyurethane.

7. A squeegee according to claim 1, wherein said squeegee is made of polyester.

8. A squeegee according to claim 1, wherein said squeegee is made of polyether.

9. A screen printing squeegee system comprising:

a squeegee having a center section including outward projections, a first substantially rectangular shaped element having a first planar working surface adjacent to said center section and having a first longitudinal axis, at least one of said outward projections extending above said first planar working surface, a second substantially rectangular element having a second planar working surface adjacent to said center section and having a second longitudinal axis, at least one of said outward projections extending above said second planar working surface, said first longitudinal axis and said second longitudinal axis intersecting at an angle unequal to zero;

a first clamping plate having a first cutout;

a second clamping plate having a second cutout; and clamping means for attaching said first and second clamping plates together with said outward projections clamped within said first and second cutouts.

10. A screen printing squeegee system comprising:

a squeegee having a center section including outward projections, a first substantially rectangular shaped element having a first planar working surface adjacent to said center section and having a first longitudinal axis, at least one of said outward projections extending above said first planar working surface, a second substantially rectangular element having a second planar working surface adjacent to said center section and having a second longitudinal axis, at least one of said outward projections extending above said second planar working surface said first longitudinal axis and said second longitudinal axis intersecting at an angle between 10° and 12°;

a first clamping plate having a first cutout;

a second clamping plate having a second cutout;

clamping means for attaching said first and second clamping plates together with said outward projections clamped within said first and second cutouts;

said first substantially rectangular shaped element, said second substantially rectangular shaped element and said center section are made of polyurethane and are unistructurally formed; and said first substantially rectangular shaped element and said second substantially rectangular shaped element are of different lengths.

11. A squeegee for use in a holder having opposed cutouts comprising:

a vertical element having a first planar working surface and a first longitudinal axis;

an angled element having a second planar working surface and a second longitudinal axis oriented away from said first longitudinal axis to form an angle unequal to zero, said angled element including an edge for spreading ink across a screen; and a center section having outward projections for positioning within said cutouts to secure said squeegee in said holder, at least one of said outward projections extending above said first planar working surface and at least one of said outward projections extending above said second planar working surface.

12. A screen printing squeegee system comprising:

a squeegee having a center section including outward projections, a vertical element having a first planar working surface and a first longitudinal axis, at least one of said outward projections extending above said first planar working surface, an angled element having a second planar working surface and a second longitudinal axis, at least one of said outward projections extending above said second planar working surface, said second longitudinal axis oriented away from said first longitudinal axis to form an angle between 10° and 12°, said angled element including an edge for spreading ink across a screen;

a first clamping plate having a first cutout;

a second clamping plate having a second cutout;

clamping means for attaching said first and second clamping plates together with said outward projections clamped within said first and second cutouts;

said vertical element, said angled element and said center section are made of polyurethane and are unistructurally formed; and said vertical element and said angled element are of different lengths.

* * * * *